US010087661B2

(12) United States Patent
Ilardo et al.

(10) Patent No.: US 10,087,661 B2
(45) Date of Patent: Oct. 2, 2018

(54) VEHICLE PANEL HANDLE ASSEMBLY

(71) Applicant: U-Shin Italia S.P.A, Pianezza (IT)

(72) Inventors: Simone Ilardo, Pianezza (IT); Alberto Tropini, Pianezza (IT)

(73) Assignee: U-SHIN ITALIA S.P.A., Pianezza (IT)

( * ) Notice: Subject to any disclaimer, the term of this patent is extended or adjusted under 35 U.S.C. 154(b) by 732 days.

(21) Appl. No.: 14/443,526

(22) PCT Filed: Nov. 18, 2013

(86) PCT No.: PCT/EP2013/074079
§ 371 (c)(1),
(2) Date: May 18, 2015

(87) PCT Pub. No.: WO2014/079810
PCT Pub. Date: May 30, 2014

(65) Prior Publication Data

US 2015/0322699 A1 Nov. 12, 2015

(30) Foreign Application Priority Data

Nov. 20, 2012 (EP) ..... 12425184

(51) Int. Cl.
*E05B 3/00* (2006.01)
*E05B 77/06* (2014.01)
(Continued)

(52) U.S. Cl.
CPC ..... *E05B 77/06* (2013.01); *E05B 77/02* (2013.01); *E05B 77/04* (2013.01); *E05B 77/12* (2013.01);
(Continued)

(58) Field of Classification Search
CPC ..... E05B 77/06; E05B 79/10; E05B 85/16; E05B 77/02; E05B 77/12
(Continued)

(56) References Cited

U.S. PATENT DOCUMENTS 9,151,320 B2 * 10/2015 Savant ..... E05B 85/16
2002/0059693 A1 * 5/2002 Jooss ..... E05B 77/06
16/412
(Continued)

FOREIGN PATENT DOCUMENTS

DE 10 2008 062213 A1 6/2010
FR 2 882 386 A1 8/2006
(Continued)

OTHER PUBLICATIONS

International Search Report issued in corresponding PCT Application No. PCT/EP2013/074079 dated Jan. 21, 2014 (3 pages).

*Primary Examiner* — Kristina R Fulton
*Assistant Examiner* — Faria F Ahmad
(74) *Attorney, Agent, or Firm* — Burris Law, PLLC

(57) ABSTRACT

A vehicle panel handle assembly including a handle lever that rotates around a first rotation axis between a resting position where the panel is closed and an opening position where the panel is open is disclosed. A latch lever cooperates with the handle lever for opening the panel when the handle lever rotates around the first rotation axis for reaching the opening position. The assembly also includes a counterweight for preventing the unwilling rotation of the handle lever, the counterweight rotating around a third rotation axis between rest position in which the latch lever is prevented from rotating due to the handle and counterweight mass balancing, and a unrest position wherein the latch lever is not prevented from rotating. An inertial mass takes a blocking position by cooperating with at least a part of the latch lever and a rest position by being taken away from the latch lever.

10 Claims, 2 Drawing Sheets

Figure 1:
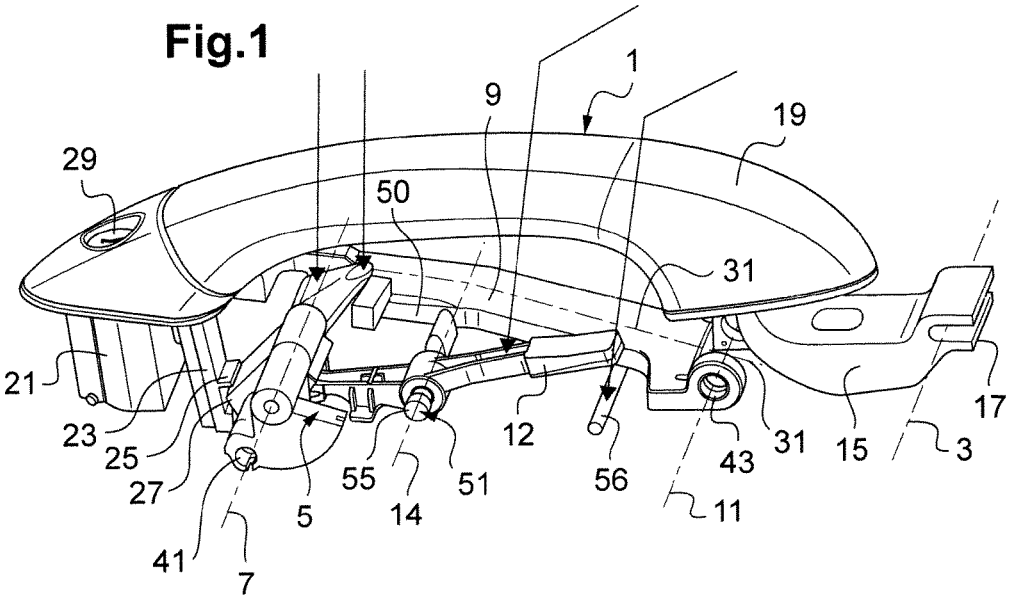

(51) Int. Cl.

| | |
|---|---|
| ***E05B 79/10*** | (2014.01) |
| ***E05B 77/02*** | (2014.01) |
| ***E05B 77/12*** | (2014.01) |
| ***E05B 77/04*** | (2014.01) |
| ***E05B 85/16*** | (2014.01) |

(52) U.S. Cl.
CPC ..... *E05B 79/10* (2013.01); *E05B 85/16* (2013.01); *Y10T 292/57* (2015.04)

(58) Field of Classification Search
USPC ..... 292/336.3, DIG. 22
See application file for complete search history.

(56) References Cited

U.S. PATENT DOCUMENTS

2006/0163887 A1* 7/2006 Savant ..... E05B 77/06 292/336.3
2008/0028885 A1* 2/2008 Monig ..... E05B 85/16 74/523
2008/0036219 A1* 2/2008 Savant ..... E05B 77/06 292/336.3
2010/0225127 A1* 9/2010 Muller ..... E05B 77/06 292/336.3
2011/0120022 A1 5/2011 Papanikolaou et al.
2011/0163554 A1 7/2011 Patel
2011/0204662 A1* 8/2011 Savant ..... E05B 85/16 292/336.3
2013/0234455 A1* 9/2013 Rocci ..... E05B 77/06 292/336.3
2014/0292005 A1* 10/2014 Bendel ..... E05B 77/06 292/336.3
2014/0312633 A1* 10/2014 Ilardo ..... E05B 77/06 292/336.3
2014/0375068 A1* 12/2014 Niegeloh ..... E05B 7/00 292/336.3
2015/0233154 A1* 8/2015 Smart ..... E05B 85/103 70/237
2016/0069104 A1* 3/2016 Ilardo ..... E05B 77/06 292/336.3

FOREIGN PATENT DOCUMENTS

WO 2010/037622 A1 4/2010
WO 2010/133372 A1 11/2010

* cited by examiner

VEHICLE PANEL HANDLE ASSEMBLY

The invention relates to a vehicle panel handle assembly comprising a handle lever configured to rotate around a first rotation axis, a latch lever configured to cooperate with the handle lever for opening the panel when the handle lever rotates around the first rotation axis, the said main lever being rotatable around a second rotation axis, a counterweight configured for preventing the unwilling rotation of the handle lever, being movable in rotation around a third rotation axis, and an inertial mass intended to take a blocking position by cooperating with at least a part of the latch lever and a rest position by being taken away from the latch lever, the said inertial mass being moveable in rotation around a fourth rotation axis.

It is known a vehicle panel handle wherein a handle lever is configured to rotate around a first rotation axis between a rest position wherein the panel, usually a door, is closed and an opening position wherein the panel is open. This handle lever cooperates with a latch lever and rotates this latter around a second rotation axis. The latch lever activates a Bowden cable in order to open the latch of the panel in the opening position.

During the rotation to open the panel, the latch lever engages a counterweight through usually an arm. The counterweight is typically equipped with a coil spring located around the rotation axis. The said coil spring determines the actuation force of the handle lever during the normal panel opening and brings back in the rest position the assembly of the handle when the user releases the handle lever.

The counterweight is also configured for balancing the handle mass and for preventing the unwilling rotation of the handle lever during a car accident. Specifically, the counterweight is configured to rotate around a third rotation axis between a rest position wherein the latch lever is prevented from rotating and an unrest position wherein the latch lever is free to rotate.

During a vehicle accident, the inertial loads exert on the handle and also on the assembly positive and negative accelerations.

Usually, during positive acceleration, which corresponds to an inertial load exiting from the door, the counterweight is configured to block the latch lever due to the connection between the latch lever and the counterweight. Consequently the handle is blocked. After a positive acceleration, usually a negative acceleration occurs. Such negative acceleration corresponds to the inertial load coming through the panel. The handle is pushed against the panel and does not act onto the latch lever. The latch lever then stays in the rest position without acting on the latch. During the negative acceleration phase, the counterweight is free to rotate until the end of stroke but the said counterweight does not act on the latch lever. Therefore, the Bowden cable is hold in rest position and the latch remains closed as well as the vehicle panel.

Sometimes, the handle undergoes again a change in the inertial load direction. Therefore, the counterweight undergoes again a positive acceleration. In this condition, the counterweight due to is previous rotation during the negative acceleration, is not pushing on the latch lever. The latch lever is then free to move. The latch lever is then not engaged with the counterweight anymore and the handle may be opened very quickly.

It is known to use an inertial mass for preventing such issue but such known handles is not efficient enough.

There is thus a need for providing a vehicle panel handle with a better level of security during a car accident when a positive acceleration follows a negative acceleration.

Therefore, according to one aspect, the present invention relates to a vehicle panel handle assembly comprising:

- a handle lever configured to rotate around a first rotation axis between a resting position wherein the panel is closed and an opening position wherein the panel is open,
- a latch lever intended to cooperate with the handle lever for opening the panel when the handle lever rotates around the first rotation axis for reaching the opening position, the said latch lever being configured for rotating around a second rotation axis,
- a counterweight configured for preventing the unwilling rotation of the handle lever, the counterweight being capable of rotating around a third rotation axis between rest position wherein the latch lever is prevented from rotating due to the handle and counterweight mass balancing, and a unrest position wherein the latch lever is not prevented from rotating,
- an inertial mass intended to take a blocking position by cooperating with at least a part of the latch lever and a rest position by being taken away from the latch lever, the said inertial mass being configured to rotate around a fourth rotation axis, wherein the fourth rotation axis is mounted on the counterweight.

Thanks to the disposition of fourth rotation axis mounted directly on the counterweight, the rotation of the inertial mass is done more quickly as in the known panel handle since a lower rotation of the inertial mass is needed for blocking the latch lever. There is no time for the handle to be opened when the handle undergoes a positive acceleration after a negative acceleration. The vehicle panel handle of the invention thus avoids any opening of the panel by preventing any rotation of the handle lever during a car accident.

Therefore, the present invention improves the security of the user placed inside the vehicle by a cooperation of four rotation axes of the elements of the assembly.

Furthermore, the assembly of the present invention may be employed onto handle presenting different type of design, in particular onto any grip handle with different shape and mass.

In a simple and cheapest way, the assembly of the present invention enables the improvement of the security in case of a car accident without amending the exterior aspect neither of the handle nor of the panel.

The present invention may also comprise the following features taken alone or in combination:

- the inertial mass rotates around a pin having a rotation axis corresponding to the fourth rotation axis,
- the pin passes through hole and/or recess made in the counterweight and in the inertial mass,
- the pin comprises means for preventing the inertial mass from moving along the said pin,
- the first, second, third and fourth rotation axes are disposed sensibly parallel to each other,
- the counterweight has an elongated shape and the second axis is disposed between the first and the third axes,
- a stopper is put on the bracket or on/in the counterweight so that the inertial mass is prevented from too high rotation angle.

The invention also relates to a vehicle panel handle comprising an assembly according to the invention and a vehicle comprising such vehicle panel handle. Advantageously, the panel may be a side door or a trunk.

Figure 2:
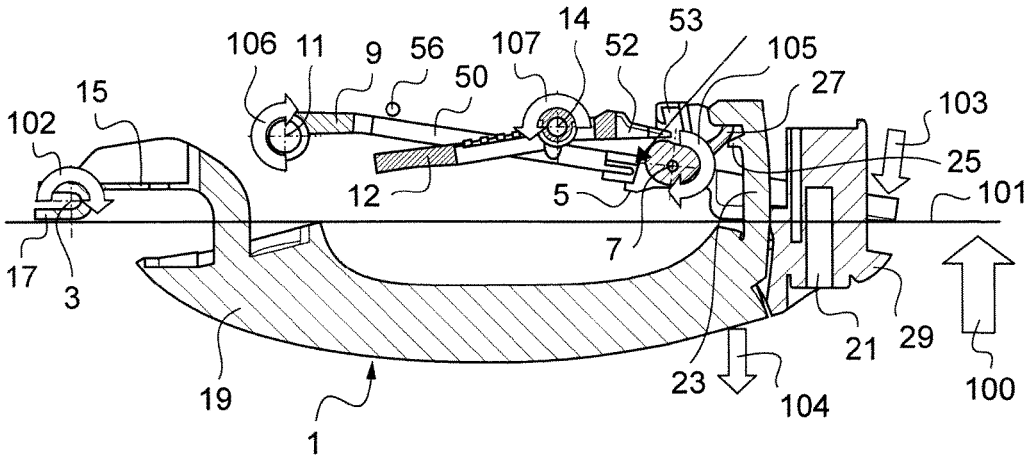
Figure 3:
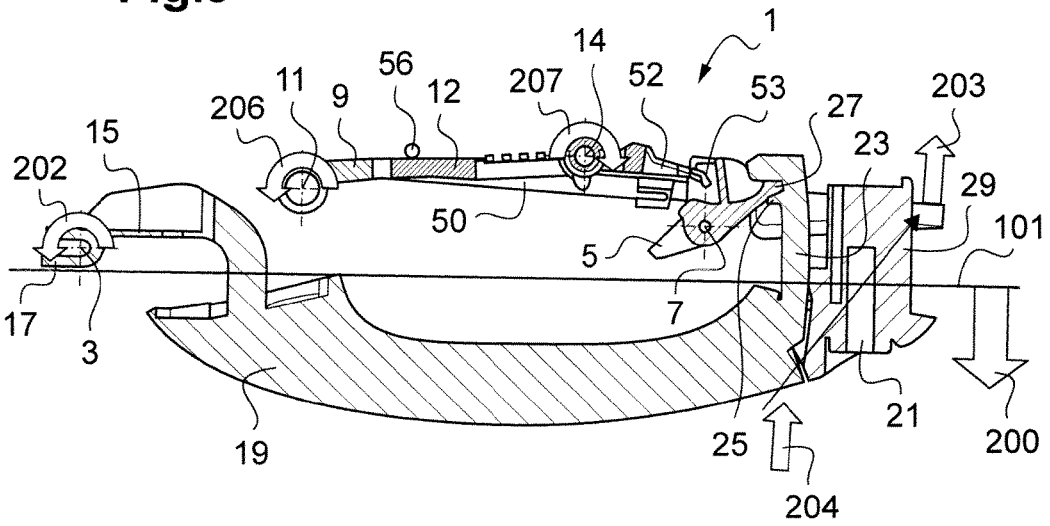
Figure 4:
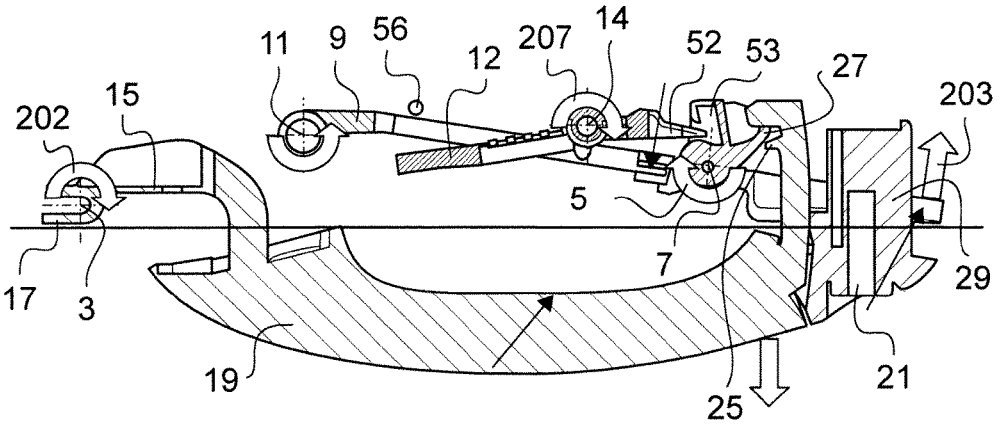

The present invention will be better understood at the light of the following description given as example and illustrated by the following drawings:

FIG. 1 is a perspective view of an embodiment of safety assembly of the invention, FIG. 2 is a cross view of the embodiment of FIG. 1 in case of low positive acceleration, also called static balancing, FIG. 3 is a cross view of the embodiment of FIG. 1 at low negative acceleration, FIG. 4 is a cross view of the embodiment of FIG. 1 at positive higher acceleration.

On all figures, the same references relate to the same elements.

According to the invention, the vehicle panel handle assembly enables the opening of a panel of an automotive vehicle.

Such panel may be a door, such as a side door, or even a trunk.

As illustrated in all figures, the assembly of the invention comprises:

- a handle lever 1 configured to rotate around a first rotation axis 3 between a resting position wherein the panel (not shown) is closed and an opening position wherein the panel is open,
- a latch lever 5 intended to cooperate with the handle lever 1 for opening the panel when the handle lever 1 rotates around the first rotation axis 3 for reaching the opening position, the said latch lever 5 being configured for rotating around a second rotation axis 7,
- a counterweight 9 configured for preventing the unwilling rotation of the handle lever 1, the counterweight 9 being capable of rotating around a third rotation axis 11 between rest position wherein the latch lever 5 is prevented from rotating due to the handle and counterweight mass balancing, and a unrest position wherein the latch lever 5 is not prevented from rotating,
- an inertial mass 12 intended to take a blocking position by cooperating with at least a part of the latch lever 5 and a rest position by being taken away from the latch lever 5, the said inertial mass 12 being configured to rotate around a fourth rotation axis 14,
- wherein the fourth rotation axis 14 is mounted on the counterweight 9.

The disposition of the fourth rotation axis mounted directly on the counterweight enables a speed of rotation of the inertial mass more quickly than the one in the known panel handles. Indeed, thanks to the invention, only a rotation with a small angle is needed for blocking the latch lever. The handle is then blocked well before the inertial load tends to open the said handle when the said handle undergoes a positive acceleration after a negative one. The vehicle panel handle of the invention thus avoids any opening of the panel by preventing any rotation of the handle lever during a side impact.

Furthermore, the panel handle of the present invention may be employed to handle with different kind of shape and specifically to heavy handle.

In a simple and not costly way, the handle of the present invention enables improving the security in case of car accident without amending the exterior aspect of the handle and of the panel.

The handle also may comprise a support also called "bracket", not shown, on which the handle lever 1, the latch lever 5 and the counterweight 9 are mounted. The support may be fixed in the panel. Advantageously, the support may be able to receive the first 3, second 7 and third 11 axes.

The handle lever 1 rotates around the first axis 3. For this purpose, the handle lever 1 may have a part, here localized sensibly at an end 15, forming an opening, a hole 17 or a recess. The said hole or recess may have a shape sensibly of a U or V. A pin (not shown), for example fixed or belonging to the support or to the panel, may go through the opening, the hole 17 or the recess of the handle lever authorizing the rotation of the said handle lever 1 around the first axis 3. The first rotation axis movement is transmitted to the rest of the handle lever 1 by a piece with a sensibly curved shape for enabling the handle lever 1 to move outside the panel. Indeed, for esthetic reason, the handle lever may be placed so that only a part 19 intended to be gripped by the user is visible from the outside of the automotive vehicle.

The handle lever 1 may also comprise means for cooperating with the latch lever 5. The said means may be for example a pin 23 configured for making the latch lever 1 rotate. In this perspective, the pin 23 may have a recess or an outgrowth 25 capable of cooperating with respectively an outgrowth or a recess 27 made in a part of the latch lever 1.

The said latch lever 5 is connected to a Bowden cable (not shown) linked to the latch (not shown). Once the latch lever 5 rotates around the second axis 7, the Bowden cable activates the latch and then the panel is open.

For providing the rotation movement, the latch lever 5 may have an opening 41 made through the body of the latch lever intended to receive a pin (not shown) mounted on the support or on the panel.

The support may also comprise a fixed part 21 (see FIGS. 2 and 3) enabling a part of the handle lever 1 to be inserted through or fixed on the said fixed part 21. The said fixed part 21 may be configured for receiving a control element such as a lock 29 intended to receive a key (see FIGS. 2 and 3). For this purpose the said fixed part 21 may delimit a recess (not visible) for receiving the said lock 29.

The said fixed part 21 is fixed relative to the mobile handle lever 1 capable of rotating around the first axis 3.

According to the present embodiment, the latch lever 5 is put between the around first axis 3 and the pin 23 of the handle lever.

The counterweight 9 is configured for preventing the unwilling rotation of the handle lever 1, specifically at low acceleration during a car accident. The counterweight 9 has an elongated shape around a longitudinal axis 31. The said counterweight 9 may have a sensibly parallelepiped shape with a length sensibly higher than the thickness according to the longitudinal axis 31.

The said counterweight 9 is movable in rotation around a third rotation axis 11. In this purpose, the said counterweight may have a part forming with an opening 43 through which a pin fixed or belonging to the support may pass. Said opening 43 may be made at an end of the counterweight.

The counterweight 9 may rotate around the third rotation axis 11. The said counterweight 9 comes into abutment against a part of the latch lever 5. Thus, the movement of the counterweight is determined by the latch lever in case of handle manual activation or it's free in case of negative acceleration phase.

The said part may be an arm (not shown) intended to cooperate with a recess or an outgrowth (not shown) of the latch lever 5 which is a simple configuration.

In the rest position corresponding to the normal use, the counterweight is placed in contact with the latch lever so that the user can normally pull the handle lever which will make the latch lever rotate and then activate the latch for opening the panel by feeling the counterweight spring force.

According to the invention, the inertial mass 12 is intended to take a blocking position by cooperating with at least a part of the latch lever 5 and a rest position by being taken away from the latch lever 5, the said inertial mass 12 being configured to rotate around a fourth rotation axis 14. The fourth rotation axis 14 is mounted directly on the counterweight 9.

In other words, the fourth rotation axis 14 is a line going through the counterweight 9.

Therefore, the rotation of the inertial mass 12 is linked to the rotation of the counterweight 9. The delay between these two rotations is then well reduced enabling a quick blocking of the handle.

In the present embodiment, the inertial mass 12 is attached to the counterweight 9 by a side wall 50 of said counterweight.

The inertial mass may have an end 52 designed for cooperating with a part 53 of the latch lever 5. The said part 53 may be form a recess wherein the said end 52 is intended to be received after the rotation of the inertial mass 12.

A stopper 56 may be put on the bracket or on/in the counterweight 9 so that the inertial mass 12 is prevented from too high rotation angle. In this perspective, the inertial mass comprises an end 57, the opposite end of the end 52 cooperating with the latch lever 5, which is configured to cooperate with the stopper 56.

The said stopper 56 may be of any shape, in particular in an elongated shape.

The inertial mass 12 may rotates around a pin 51 having a rotation axis corresponding to the fourth rotation axis.

The pin may belong to the inertial mass. In this configuration, the pin is then received in a hole or a recess made in the counterweight.

The pin may be fixed or belongs to the counterweight 9 and the inertial mass 12 may comprise a hole for receiving such pin.

In the present embodiment, the pin 51 passes through hole and/or recess made in the counterweight 9 and in the inertial mass 12. Thanks to the invention, the counterweight mass can be reduced because the inertial mass contributes to the counterweight mass. The pin may comprise means 55 for preventing the inertial mass 12 from moving along the said pin 51.

According to an embodiment, the first 3, second 7, third 11 and fourth 14 rotation axes are disposed sensibly parallel to each other.

In case the counterweight 9 has an elongated shape along a longitudinal axis 31, the second axis 7 may be disposed between the first 3 and the third axes 11.

In the normal use, the inertial mass 12 is in the unblocking position which means that the counterweight 9 cooperates with the latch lever 7 by the protrusions 60 and 61. The inertial mass 12 is placed away from the latch lever 7 so that the user can normally pull the handle lever 1 which will make the latch lever 3 rotate around the second axis 7, the counterweight 9 rotates around the third axis 11 and then activate the latch for opening the panel.

In case of an impact, a positive acceleration occurs. A force 100 is applied to the panel 101. The panel 101 and also the support of the handle 1 of the invention are deformed leading to the rotation of the handle lever 1 around the first rotation axis 3 (arrows 102, 103 and 104). The means 23 will therefore tend to rotate the latch lever 5 around the second axis 7 (arrow 105). At law acceleration, the counterweight 9 stays in rest position and stops the rotation of the latch lever 5. At higher acceleration, the inertial mass 12 then rotates quickly around the fourth rotation axis 14 (arrow 107) which leads to the engagement of the end 52 of the inertial mass 12 inside the part 53 of the latch lever. Due to the presence of the stopper 56, the inertial mass rotation is limited. Therefore, the latch lever 5 is blocked by the inertial mass 12 and also the counterweight 9.

In case of a bouncing movement, which means that a negative acceleration follows the positive acceleration which is responsible of the application of a force 200 applied to the panel 101 in a direction opposite to the direction of the force due to the positive acceleration. The panel 101 and also the support of the handle 1 of the invention are deformed so that the handle lever rotates in the opposite direction around the first axis 3 (see arrow 202, 203 and 204). The handle is then pushed close to the panel. The counterweight 9 also undergoes the rotation in the same direction as the one of the lever handle 19 but around the third axis 11. The counterweight 9 then rotates at the end of stroke position, also called unrest position. The inertial mass 12 undergoes a torque 207 in the opposite direction than the one 206 applied to the counterweight 9. Therefore, the inertial mass 12 remains in the locking position, the latch lever 5 remains blocked and cannot activated the latch.

Thanks to the invention, the latch cannot be activated during positive acceleration and negative acceleration sequences.

In case of a normal use, the handle lever is rotated around the first rotation axis by the pulling of the said handle lever by the user. The latch lever then rotates around the second rotation axis which leads to the rotation of the counterweight around the third rotation axis. The inertial mass is also free to rotate so that the latch lever can act on the latch.

The invention claimed is:

1. A vehicle panel handle assembly comprising:

a handle lever configured to rotate around a first rotation axis between a resting position wherein the panel is closed and an opening position wherein the panel is open;

a latch lever configured to enable a rotation with the handle lever for opening the panel when the handle lever rotates around the first rotation axis for reaching the opening position, the latch lever being configured for rotating around a second rotation axis;

a counterweight configured for preventing the unwilling rotation of the handle lever, the counterweight being capable of rotating around a third rotation axis between rest position wherein the latch lever is prevented from rotating due to the handle and counterweight mass balancing, and a unrest position wherein the latch lever is not prevented from rotating; and an inertial mass intended to take a blocking position by cooperating with at least a part of the latch lever and a rest position by being taken away from the latch lever, the inertial mass being configured to rotate around a fourth rotation axis, wherein the fourth rotation axis is mounted on the counterweight.

2. The assembly according to claim 1, wherein the inertial mass rotates around a pin having a rotation axis corresponding to the fourth rotation axis.

3. The assembly according to claim 2, wherein the pin passes through hole and/or recess made in the counterweight and in the inertial mass.

4. The assembly according to claim 2, wherein the pin comprises means for preventing the inertial mass from moving along the pin.

5. The assembly according to claim 1, wherein the first, second, third and fourth rotation axes are disposed sensibly parallel to each other.

6. The assembly according to claim 1, wherein the counterweight has an elongated shape and the second axis is disposed between the first and the third axes.

7. The assembly according to claim 1, wherein a stopper is put on the bracket or on/in the counterweight so that the inertial mass is prevented from too high rotation angle.

8. A vehicle panel handle comprising an assembly according to claim 1.

9. A vehicle comprising a vehicle panel handle according to claim 8.

10. The vehicle according to claim 9, wherein the panel is a side door or a trunk.

* * * * *